US011462065B1

(12) United States Patent
Ogram

(10) Patent No.: US 11,462,065 B1
(45) Date of Patent: Oct. 4, 2022

(54) SECURITY SYSTEM

(71) Applicant: Mark Ellery Ogram, Tucson, AZ (US)

(72) Inventor: Mark Ellery Ogram, Tucson, AZ (US)

( * ) Notice: Subject to any disclaimer, the term of this patent is extended or adjusted under 35 U.S.C. 154(b) by 0 days.

(21) Appl. No.: 17/300,978

(22) Filed: Jan. 5, 2022

(51) Int. Cl.
*G08B 21/00* (2006.01)
*G07C 9/00* (2020.01)
*G08B 13/04* (2006.01)

(52) U.S. Cl.
CPC ..... *G07C 9/00658* (2013.01); *G07C 9/00896* (2013.01); *G08B 13/04* (2013.01)

(58) Field of Classification Search
CPC . G07C 9/00658; G07C 9/00896; G08B 13/04
USPC ..... 340/5.51
See application file for complete search history.

(56) References Cited

U.S. PATENT DOCUMENTS 4,262,589 A 4/1981 Gebhardt
5,038,328 A 8/1991 Brunius
5,602,936 A 2/1997 Green
7,391,319 B1 * 6/2008 Walker ..... G08B 7/06 340/5.31
7,918,191 B2 4/2011 Gipson
10,445,957 B2 * 10/2019 Savolainen ..... H04L 67/56
10,446,025 B2 10/2019 Yu
10,600,573 B2 3/2020 Gitchell
10,634,463 B1 4/2020 De Angeles
10,823,383 B1 11/2020 Beausoleil
11,036,948 B2 6/2021 Lei
11,062,103 B2 7/2021 Zhao
11,068,697 B2 7/2021 Liu
11,068,762 B2 7/2021 Goldstein
11,074,431 B2 7/2021 Yamada
11,093,721 B2 8/2021 Burchell
11,141,062 B2 10/2021 Geissler
11,170,643 B1 11/2021 Carter
2006/0055534 A1 * 3/2006 Fergusson ..... G08B 29/22 340/562
2007/0222621 A1 * 9/2007 Cole ..... E06B 7/32 340/573.1
2018/0286209 A1 * 10/2018 Singh ..... G08B 29/181

* cited by examiner

*Primary Examiner* — Mark S Rushing
(74) *Attorney, Agent, or Firm* — Mark Ogram

(57) ABSTRACT

A security mechanism for a store in which the exit door is selectively locked when an alarm, such as the sound of breaking glass is sensed. The locked door, once locked in response to a security alarm, is opened by the presence of an emergency vehicle proximate to the store, thereby allowing police to enter the store.

11 Claims, 5 Drawing Sheets

SECURITY SYSTEM

PRIORITY

This is a Continuation-In-Part of U.S. patent application Ser. No. 17/300,555, filed on Aug. 16, 2021, and entitled "Anti-Shoplifting System".

BACKGROUND OF THE INVENTION

This invention relates generally to anti-theft mechanisms and more specifically to anti-shoplifting.

Store security has always been a priority for any retail outlet. Thefts of goods has taken many forms including the simple slipping the item into a purse, wearing the garment from the store, to grab and run with the item. As shoplifting of stores increases, the business has no alternative but to raise the prices on the goods sold to legitimate purchasers to compensate.

While historically, the shoplifting has been relatively minor in scope, a more modern problem has arisen in which groups of individuals enter the store, take what they want and either run, or in some situations, stroll out of the store.

Shopkeepers have very few options available, to confront the thieves invites violence which has resulted in the death of the shop keeper. The only real solution for the shopkeeper is to simply let the shoplifter leave the store.

This though invites further brazen thefts when the thieves know that the shopkeeper will do nothing to curtail their criminal activity.

It is clear there is a need to provide further security from shoplifting.

SUMMARY OF THE INVENTION

The invention utilizes an existing cash register for a retail store that, in processing the purchases, establishes an identifier (such as a date stamp, barcode, QR code) on the receipt. In the invention, this code/identifier is used at an exit portal to trigger the opening of a barrier allowing the purchaser to leave the building. In the preferred embodiment, an image of the customer is taken on entering and leaving the building and facial recognition is made for the purpose, in the case of a successful shoplifting, for later apprehension or for future denial of entry into the store.

The preferred embodiment of the invention uses a register commonly found in retail stores. The register is configured to process a purchase for checkout and to print a receipt of the purchases. In the present invention the receipt includes an identifier such as a date label, a bar code, or a QR code in either visible or invisible ink. When the customer approaches an exit portal, there is a primary barrier (such as an arm or a door) which prevents exit until opened. A scanner is positioned for the customer to use the receipt's identifier to selectively remove/open the primary barrier so that the customer may exit the building.

The use of gates or barriers is well known in the art and include that described in U.S. Pat. No. 7,918,191, entitled "Remotely Operable Gated Chute for Livestock" issued to Gibson on Apr. 5, 2011, and incorporated hereinto by reference.

As noted, a variety of identifiers or codes may be used in this context, including, but not limited to printed date, bar code, and QR codes. Ideally, these identifiers are unique to the date of the purchase and, further, are ideally unique to the particular receipt so that they can be used only once by the customer. To add further security, in one embodiment of the invention, the identifier is printed using an ink that is invisible to the human eye.

The reading of printed material is well known and includes: U.S. Pat. No. 4,262,589, entitled "Apparatus for Embossing and Printing Information on Charge Sales Slip" issued to Gebhardt on Apr. 21, 1981; and U.S. Pat. No. 5,602,936, entitled "Method of and Apparatus for Document Data Recapture" issued to Green et al. on Feb. 11, 1997; both of which are incorporated hereinto by reference.

The use of invisible ink and the like is well known in the art and includes U.S. Pat. No. 10,600,513, entitled "Medication Tracking" issued to Gitchell et al. on Mar. 24, 2020, incorporated hereinto by reference.

Bar code readers are well known to those of ordinary skill in the art and are described in such patents as: U.S. Pat. No. 11,036,948, entitled "Barcode-Scanning System Configured for both Data Validation and Data Formatting" issued to Lei et al. on Jun. 15, 2021; and U.S. Pat. No. 11,062,103, entitled "Digital Barcode Reader" issued to Zhao, et al. on Jul. 13, 2021; both of which are incorporated hereinto by reference.

OR code are an alternative to the barcode and are well known. An example include: U.S. Pat. No. 11,068,762, entitled "Dual Code Authentication Process" issued to Goldstein et al. on Jul. 20, 2021; incorporated hereinto by reference.

The preferred embodiment of the invention incorporates the use of a camera to generate an image of the incoming customer. Positioning of the camera is ideally made below a customer's face so that the full facial image is obtained and cannot be readily blocked by a hat.

This image is stored by the store and ideally a facial recognition is performed on the image.

The field and technology used in facial recognition is well known and includes: U.S. Pat. No. 11,068,697, entitled "Methods and Apparatus for Video-based Facial Recognition, electronic devices, and Storage Media" issued to Liu et al. on Jul. 20, 2021; and U.S. Pat. No. 11,074,431, entitled "Facial Recognition Device" issued to Yamada on Jul. 27, 2021; both of which are incorporated hereinto by reference.

In some embodiments, the exit portal is equipped with a secondary door which may be selectively closed behind the customer to confine the customer until law enforcement arrives. This is done when the customer attempts to shoplift items from the store.

While the exit portal is important to keep shoplifters from illegally removing goods, another aspect of this invention is the use of an entry portal as well. The entry portal is used to "screen" incoming customers to avoid allowing previous shoplifters from re-entering the store or even for denying entry to individuals who have used fraudulent credit cards or checks.

In this context, the entry portal uses a barrier to restrict free access into the store and an entry camera directed to an occupant of the entry portal and generating an electronic image thereof. A recording mechanism stores the image, facial recognition is performed and compared to a library of "undesirables". If the individual is one of the "undesirables", a message on a screen advises the individual: PLEASE TAKE YOUR BUSINESS ELSEWHERE.

The screen is also useful to direct the individual to raise their hat or face so that proper facial recognition may be made.

If no problems are encountered, the barrier is removed allowing access to the interior of the store.

In this manner, the system employs a data base of selected facial data points stored on a memory device allowing the facial recognition system to compare the current image against the data base of selected facial data points, and, maintain the entry barrier in a closed position if a match occurs between the current image and one of the selected facial data points for "undesirable" individuals.

For safety reasons, an override switch is located proximate to the register. This override switch opens the primary barrier of the exit portal and the primary barrier of the entry portal so that people may leave the building without hinderance. The override switch is also activated by the fire alarm.

In one embodiment of the invention, the entry portal and the exit portal are unified into a single unit and are supported by wheels. This allows, together with an anchoring mechanism, to move the entry/exit unified body through an opening of the store when the store is open for business and to withdraw the entry/exit unified body when the store is closed to business. The opening in the wall is then be sealed using a variety of techniques including the use of a rolling door. The anchor mechanism, for the unified unit, ideally engages with the floor of the store.

In one embodiment of the invention, a security mechanism for a store is created in which the exit door is selectively locked when an alarm, such as the sound of breaking glass is sensed. The locked door, if in response to a security alarm, is opened by the presence of an emergency vehicle proximate to the store, thereby allowing police to enter the store.

In a further enhancement of the invention, the exit door being selectively locked, but is selectively changed from a locked status to an unlocked status upon the sensing the emergency signal. In one embodiment, the changing from locked to unlocked is when a fire alarm signal is sensed.

In another embodiment, the exit door goes to a locked state when a theft alarm signal is sensed. In the preferred embodiment of this condition, a sensor is provided which senses the breaking of glass (such as a breaking of the front glass or the display cabinet glass indicating a theft in progress).

Breaking glass sensors are well known to those in the art and include U.S. Pat. No. 5,038,328, entitled "Band Pass Filter" issued to Brunius on Aug. 6, 1991, incorporated hereinto by reference.

This enhanced embodiment is further enhanced by a sensor identifying when an emergency vehicle is proximate to the front of the store, such as when the police or fire department has arrived. In the case of the arrival of the police or fire department, the front door is unlocked. This allows patrons to readily exit the store (in the case of fire) or the police to enter the store in the case of a breakin.

Those of ordinary skill in the art readily recognize a variety of mechanisms which are useful in identifying a proximate emergency vehicle, including, but not limited to: U.S. Pat. No. 10,446,025, entitled "Traffic Light Control System" issued to Yu on Oct. 15, 2019; and U.S. Pat. No. 11,170,643, entitled "Traffic Light Approach Intervening Safety System" issued to Carter on Nov. 9, 2021; both of which are incorporated hereinto by reference.

In some situations, a debilitating strobing light is used to incapacitate a thief when they are in the store (typically triggered by the sound of breaking glass).

Strobing lights used to disarm or incapacitate an intruder are well known in the art and include, but are not limited to: U.S. Pat. No. 10,634,463, entitled "Apparatus for Incapacitating An Active Shooter" issued to DeAngeles on Apr. 28, 2020; and, U.S. Pat. No. 10,823,383, entitled "Low Voltage Light Fixtures Having Articulating Components for Establishing Blinding Glare Zones at Selected Distances from the Fence Lines of Security Fences: issued to Beausoleil on Nov. 3, 2020; both of which are incorporated hereinto by reference.

In one embodiment of the invention, a Radio Frequency Identification (RFID) is attached or concealed on workers within the store. The RFID, once identified proximate to the locked door, causes the locked door to go to an unlocked state allowing patrons and the worker to escape from the store.

Those of ordinary skill in the art readily recognize a variety of mechanisms which utilize Radio Frequency Identification Devices (RFIDs), including, but not limited to: U.S. Pat. No. 11,141,062, entitled "System and Method for Animal Location Tracking and Health Monitoring Using Long Range RFID and Temperature Monitoring" issued to Geissier et al. on Oct. 12, 2021; and U.S. Pat. No. 11,093,721, entitled Apparatus and Method for Monitoring and Communicating Data Associated with a Product/Item" issued to Burchell et al. on Aug. 17, 2021; both of which are incorporated hereinto by reference.

Ideally, the entire operation is maintained by a computer or controller allowing the store's manager to set times for the system's activation.

The invention, together with various embodiments thereof, will be explained in detail by the accompanying drawings and the following description thereof.

DRAWINGS IN BRIEF

DRAWINGS IN DETAIL

Figure 1:
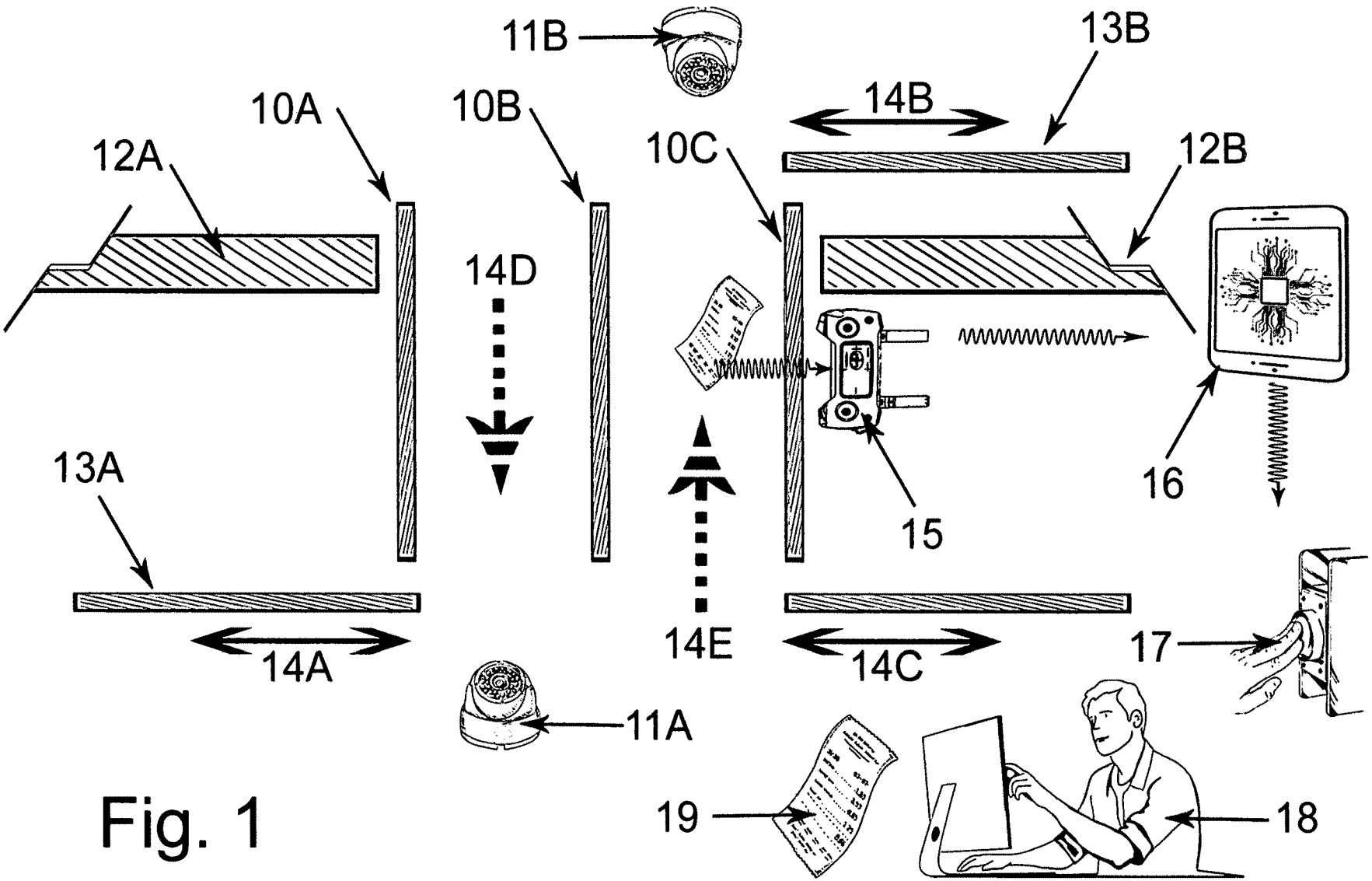
FIG. 1 is an overhead view of the preferred embodiment of the invention.

FIG. 1 is an overhead view of the preferred embodiment of the invention.

An opening between exterior walls 12A and 12B is used for ingress and egress from the store. Positioned in this opening, are panels 10A, 10B, and 10C which form two channels, one for ingress and one for egress from the store.

For egress, the customer (not shown) has obtained receipt 19 from the cash register 18. Barrier 13B has been moved to block egress as the customer passes as indicated by arrow 14E. Using receipt 19, the customer presents receipt 19 to reader 15 (positioned near a window on panel 10C). Reader 15, communicates with controller 16 which identifies the proper code (or lack thereof) and selectively move barrier 13B as indicated by arrow 14B. In this manner, a valid customer is given free access to leave the store while a shoplifter (without a receipt) is thwarted in their endeavors.

Camera 11B captures an image of the customer and communicates this image to the controller which may use facial recognition to identify the customer.

Emergency switch 17, ideally positioned near register 18, permits a store employee to cause all barriers to open in case of an emergency so that egress from the store is not hindered.

For ingress into the store, the customer enters between panels 10A and 10B as indicated by arrow 14D. As with egress, a camera 11A is used to capture an image of the entering customer for storage by controller 16 (possibly with facial recognition). Barrier 13A is typically left open but in some necessary situations, such as when the facial recognition identifies a previous thief, moves barrier 13A as indicated by arrow 14A to prevent entry.

Barriers 13A and 13B in this illustration are full or substantially full doors that slide (as indicated by arrows 14A, 14B, and 14C) to either open or close.

Figure 2A:
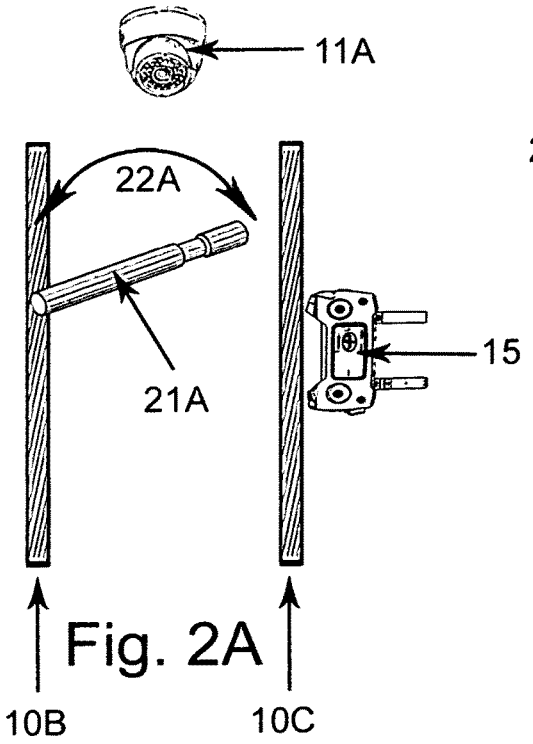
FIGS. 2A and 2B are horizontal views of the entry and exit portals.
Figure 2B:
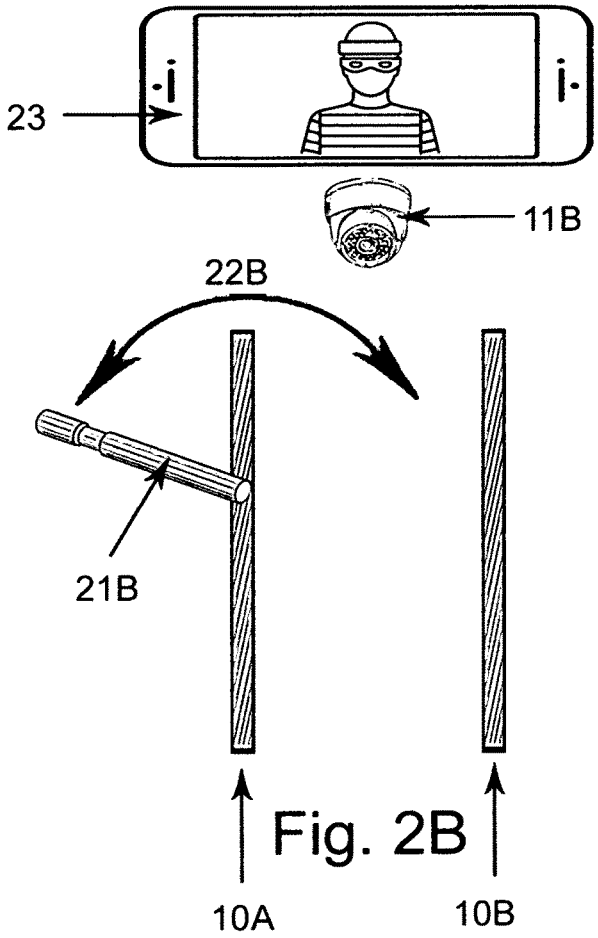

FIGS. 2A and 2B are views of the entry and exit portals.

Referring to FIG. 2A, the egress portion of the invention, looking as the customer would see the egress portion as they approach, are panels 10B and 10C forming a channel therebetween. Barrier 21B (an arm in this illustration) moves downward to block egress. The customer's image is captured by camera 11B. To move arm 21B, the customer presents his receipt to reader 15 which, if the proper code exists on the receipt, lifts arm 21B as indicated by arrow 22B.

The ode is ideally unique at least to the date and preferably to the individual purchase receipt.

The store's worker may also raise arm 21B should the need arise such as when the customer has not bought anything and then does not have a receipt, although in this situation, a "blank" receipt may be printed for the purpose of allowing egress.

FIG. 2B illustrates the ingress portion as seen by the customer seeking to enter the store between panels 10A and 10B. Camera 11A captures an image of the customer and, in one embodiment, performs facial recognition on the image to identify if the customer is someone that the store does not want to grant entry such as a former shoplifter, a writer of bad checks, has previously caused a disturbance in the store, or has used a fraudulent credit card in the past.

If the customer is a non-desirable, then arm 21A moves as indicated by arrow 22A to block entry and ideally a notice is displayed on screen 23. Screen 23 is also used to promote different sales items or for informational purposes such as hours of operation.

Figure 3:
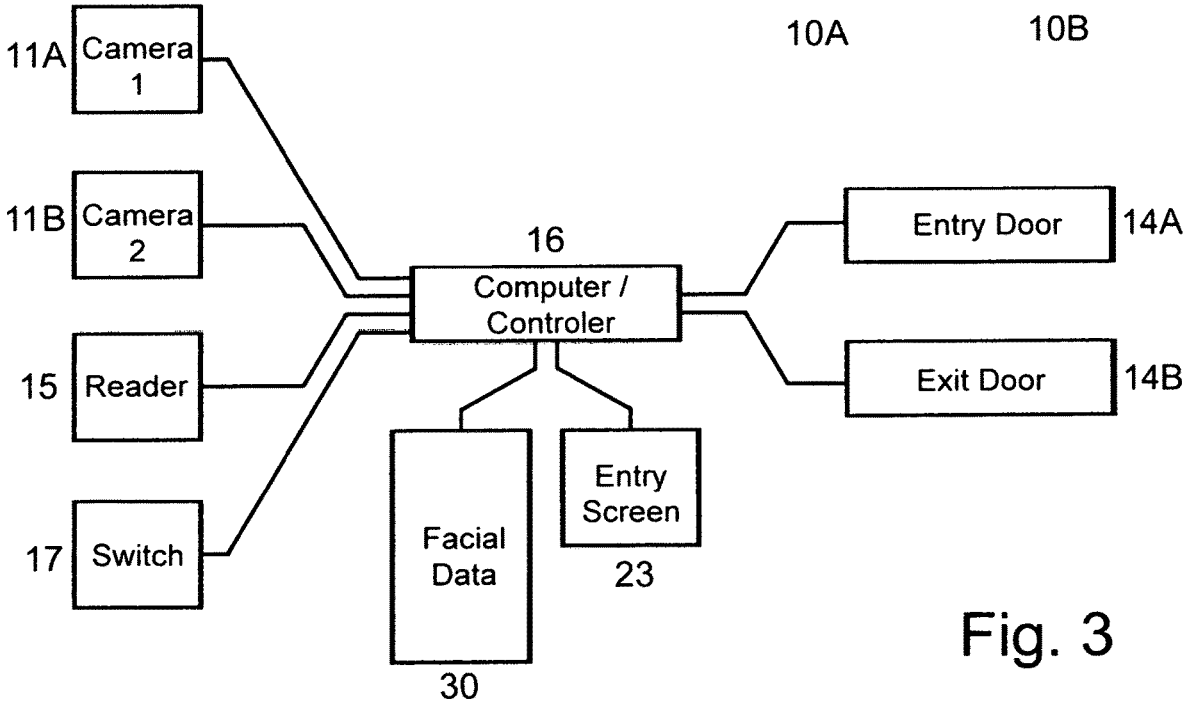
FIG. 3 is an informational flow diagram of the preferred embodiment of the invention.

FIG. 3 is an informational flow diagram of the preferred embodiment of the invention.

Controller 16 receives the images from cameras 11A and 11B, performs facial recognition, and communicates the facial recognition data to data storage 30. Data storage 30 is used to identify customers who are undesirable as well as valued customers.

Controller 16 also communicates with the customer via screen 23 and opens/closes entry door 14A and exit door 146.

Figure 4A:
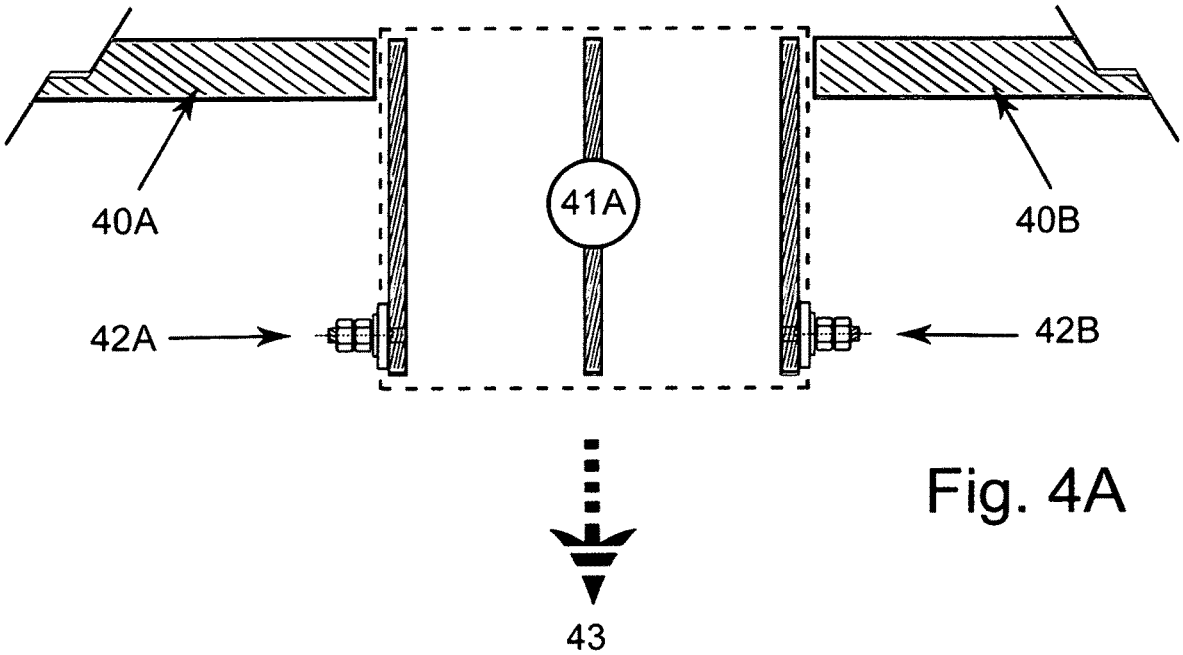
FIGS. 4A and 4B illustrate the movement of the entry/exit in an embodiment of the invention.
Figure 4B:
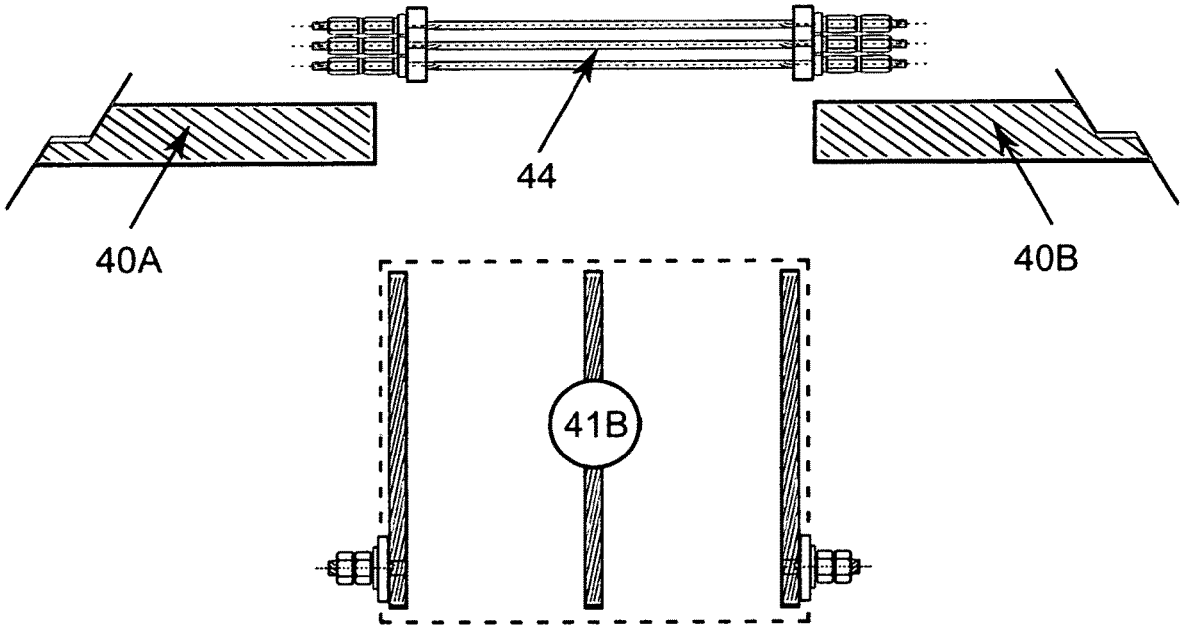

FIGS. 4A and 4B illustrate the movement of the entry/exit in an embodiment of the invention.

When the store is open for business, ingress/egress mechanism 41, as outlined above, is positioned between walls 40A and 40B. In this embodiment, ingress/egress mechanism 41 is a unified body. Latching bolts 42A and 426 are used to secure ingress/egress mechanism 41 in the position shown in FIG. 4A.

At store closing, FIG. 4B, the latching bolts 42A and 42B are released and the ingress/egress mechanism 41B, supported by wheels not shown, is pulled or rolled into the store and a rolling or security shutter/door 44 is used to securely cover the opening between wall 40A and 40B.

Figure 5:
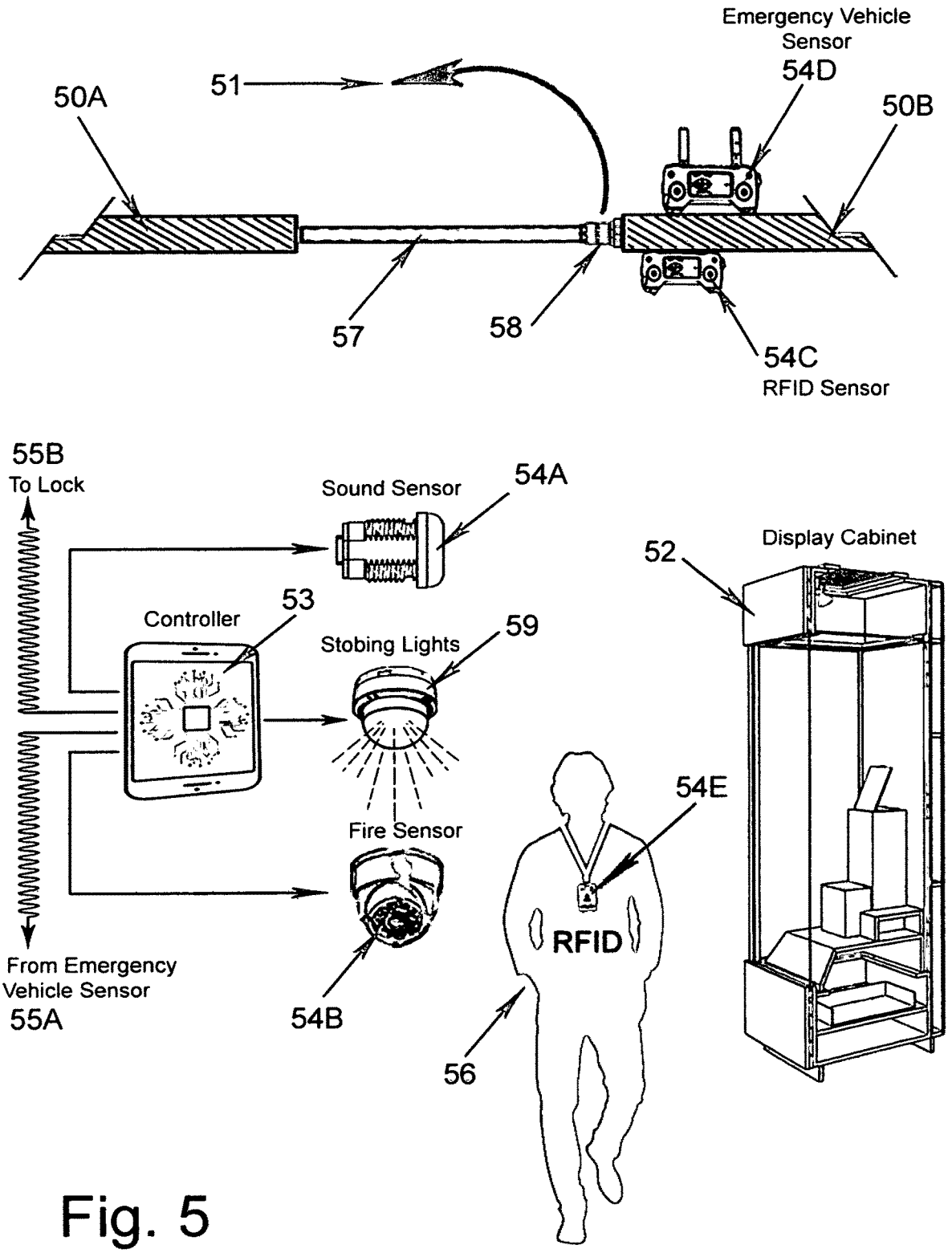
FIG. 5 is a block diagram of an embodiment of the invention.

FIG. 5 is a block diagram of an embodiment of the invention.

Exit door 57 is positioned between walls 50A and 50B and opens as indicated by arrow 51. Door 57 is secured by locking mechanism 58 which is selectively locked/unlocked via controller 53 which communicates with locking mechanism 58 either via wires or radio 55B. Controller 53 is programmable by a user to automatically unlock door 57 (when the store is open for business) and to lock door 57 (when the store is closed for business).

Within the store is display cabinet 52 which contains merchandise offered for sale by the store. In this embodiment, the top of cabinet 52 is glass allowing customers to view the merchandise. In a typical "smash and dash" type robbery, the thief smashes or breaks the glass covering to display cabinet 52.

This breaking of the glass is sensed by sound sensor 54A as discussed above. Sound sensor 54A communicates with controller 53 which then lock door 57, preventing the thief from "dashing" with the merchandise from the store.

Additionally, in one embodiment of the invention, when the breaking of glass is sensed by sound sensor 54A, controller 53 also activates a high intensity strobing light 59 which is intended to disorient the thief, now trapped within the store.

When the door is locked due to the breaking of glass as outlined above, sensor 54D for emergency vehicles determines if an emergency vehicle is proximate and communicates this to the controller 53 via wire or radio waves 55A. When this occurs, controller 53 activates lock 58 to "unlock" allowing the police entrance to the store.

If a fire is sensed by sensor 54B, a signal is sent to controller 53 which causes the door to go unlocked 58 to allow fire fighters access to the interior of the store and to allow anyone within the store to have access to escape the fire.

Another safety feature is that store employee 56 has an RFID 54E secured to their body so that when they are near the door, and it is locked, the RFID is sensed 54C, communicated to the controller 53, and the locking mechanism 58 is unlocked allowing the personnel 52 to exit the building. This is important for escaping from a thief as the door relocks after employee 56 has passed through to the exterior of the building, and also during a fire within the building.

Figure 6:
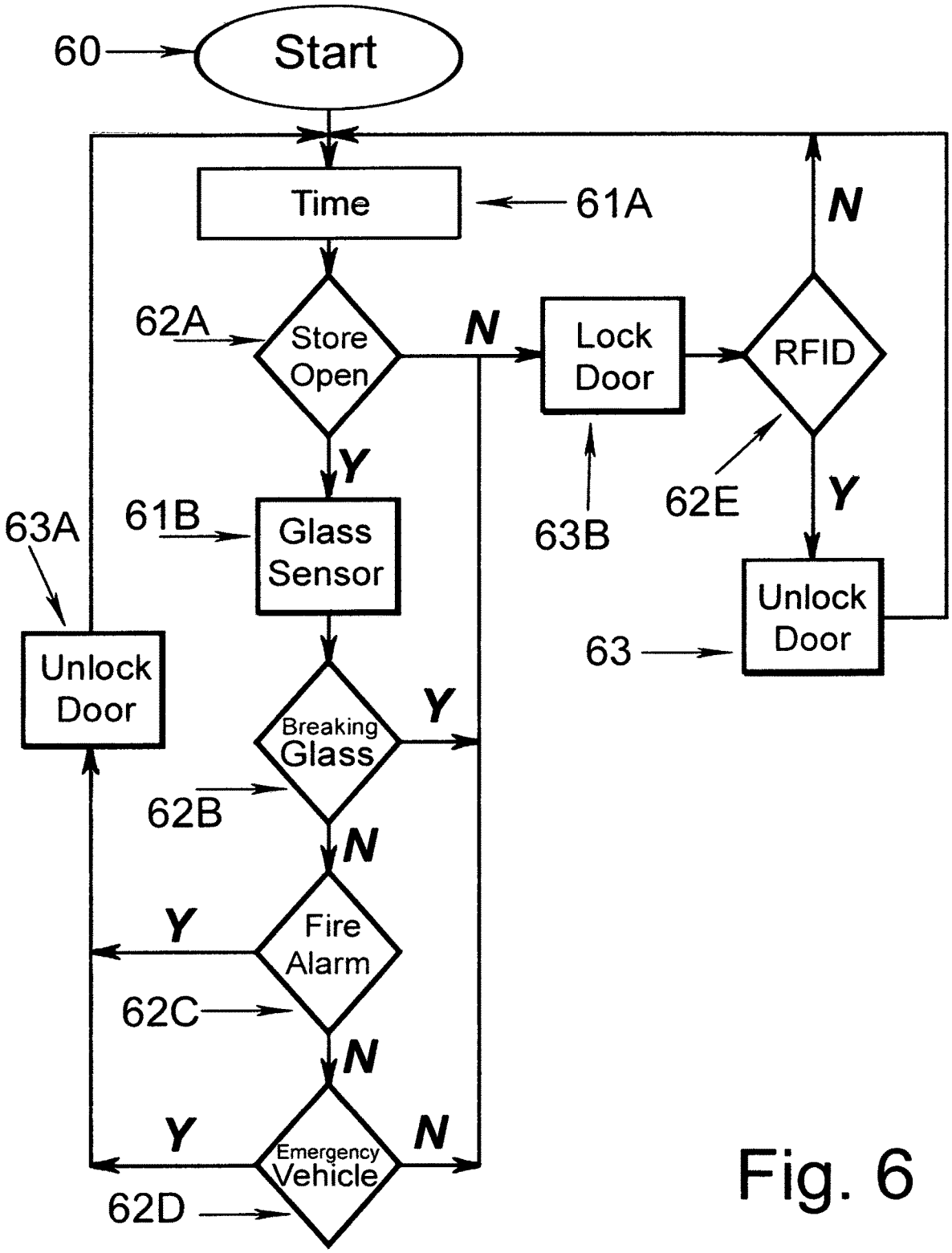
FIG. 6 is a flow-chart of the preferred operation of the of the embodiment of FIG. 5

FIG. 6 is a flow-chart of the preferred operation of the of the embodiment of FIG. 5.

Once the program starts, 60, the time is checked 61A and a determination on if the store is open for business or not 62A is made. If open, the glass sensor's input is checked 61B and a determination if breaking glass is sensed 62B; if not, then the fire alarm is checked 62C.

If the fire alarm has not been tripped, then the presence of the emergency vehicle is determined 62D. If no emergency vehicle is sensed then the door is locked 63B, a check for the RFID is made 62E to see if the door should be unlocked 63C or not, the program then returns to check the time 61A.

If the breaking of glass is sensed 62B, then the door is locked 63B.

If the fire alarm 62C has been tripped, the door is unlocked 63A and the program cycles back to check the time 61A.

If an emergency vehicle 62D is senses, the door is unlocked 63A and program returns to check the time 61A, In this manner the different sensors are continuously monitored and the appropriate action is taken.

It is clear that the present invention provides for additional security from shoplifting.

What is claimed is:

1. A safety portal for a store comprising:

a) an exit door being selectively locked;

b) a theft alarm mechanism, when activated, locks the exit door;

c) a sensor responsive to an emergency signal, said sensor changing a locked/unlocked status of the exit door upon sensing the emergency signal;

d) an emergency vehicle sensor generating an emergency vehicle signal when an emergency vehicle is located proximate to the store; and, e) wherein, once the sensor has been activated by the theft alarm mechanism, the emergency vehicle sensor assures the exit door is in an unlocked status upon the emergency vehicle signal.

2. The safety portal according to claim 1, further including a fire alarm mechanism generating the emergency signal and wherein the sensor assures the exit door is in an unlocked status upon sensing the emergency signal.

3. The safety portal according to claim 1, further including:

a) a sound sensor generating the emergency signal upon sensing a breaking of glass sound; and, b) wherein the sensor assures the exit door is in a locked status in response to the emergency signal.

4. The safety portal according to claim 3, further including a strobing light mechanism being responsive to the emergency signal, said strobing light mechanism being directed towards an interior of the store.

5. A security mechanism for a store comprising:

a) an exit door being selectively locked;

b) a sound sensor generating a security alert signal upon sensing a breaking of glass sound;

c) a locking mechanism responsive to the security alert signal to lock the exit door;

d) an emergency vehicle sensor generating an emergency vehicle signal when an emergency vehicle is located proximate to the store; and, e) an unlocking mechanism adapted to unlock the exit door upon both, 1) sensing the emergency vehicle signal, and, 2) sensing the security alert signal.

6. The security mechanism according to claim 5, further including:

a) a radio frequency identification tag generating an identification of a wearer; and, b) wherein the locking mechanism unlocks the exit door when said radio frequency identification tag is proximate to the exit door.

7. The security mechanism according to claim 6, further including a strobing light mechanism being responsive to the security alert signal, and strobing light directed towards an interior of the store.

8. The security mechanism according to claim 7, further including a control mechanism selectively activating the sound sensor during selected periods of time.

9. A security mechanism for a store comprising:

a) a sound sensor generating a security alert signal upon sensing a breaking of glass sound;

b) a strobing light mechanism responsive to the security alert signal;

c) a locking mechanism responsive to the security alert signal and adapted to lock an exit door;

d) an emergency vehicle sensor generating an emergency vehicle signal when an emergency vehicle is located proximate to the store; and, e) an unlocking mechanism adapted to unlock the exit door upon both, 1) sensing the emergency vehicle signal, and, 2) sensing the security alert signal.

10. The security mechanism for a store according to claim 9, further including a locking mechanism responsive to the security alert signal and adapted to lock an exit door.

11. The security mechanism for a store according to claim 9, further including a control mechanism selectively activating the sound sensor during selected periods of time.

* * * * *